US006367279B1

(12) United States Patent
Jin

(10) Patent No.: US 6,367,279 B1
(45) Date of Patent: Apr. 9, 2002

(54) HEAT PUMP SYSTEM

(76) Inventor: Keum Su Jin, Room 401 Jupung Village, 316-8, Kil-Dong, Kangdong-Ku, Seoul (KR)

( * ) Notice: Subject to any disclaimer, the term of this patent is extended or adjusted under 35 U.S.C. 154(b) by 0 days.

(21) Appl. No.: 09/636,087

(22) Filed: Aug. 9, 2000

(30) Foreign Application Priority Data

May 24, 2000 (KR) ..... 2000-28222

(51) Int. Cl.[7] ..... F25B 13/00

(52) U.S. Cl. ..... 62/324.1; 62/160

(58) Field of Search ..... 62/324.1, 724.6, 62/160

(56) References Cited

U.S. PATENT DOCUMENTS 3,029,614 A * 4/1962 Smith et al. ..... 62/324.6
4,493,193 A * 1/1985 Fisher ..... 62/160
4,938,032 A * 7/1990 Mudford ..... 62/160
5,065,588 A * 11/1991 Nakayama et al. ..... 62/160
6,050,102 A 4/2000 Jin

FOREIGN PATENT DOCUMENTS

JP 49-18927 5/1974

* cited by examiner

*Primary Examiner*—William C. Doerrler
(74) *Attorney, Agent, or Firm*—Hedman & Costigan, P.C.

(57) ABSTRACT

Disclosed herein is a heat pump system. The heat pump system includes a base heat pump system constructed in such a way that a compressor, a four-way valve, a first heat exchanger, two expansion valves, a second heat exchanger and the four-way valve are sequentially connected to each other by first, second, third, fourth, fifth and sixth conduits. An additional heat exchanger is disposed on an eighth conduit, the eighth conduit connecting a seventh conduit, connected to the fourth conduit at its both ends, to the portion of the fourth conduit situated between two junction points of the fourth and seventh conduits. A further additional heat exchanger is disposed on a ninth conduit, the ninth conduit connecting the second conduit to the portion of the eighth conduit situated between the third heat exchanger and a junction point of the fourth and eighth conduits and being provided with an additional expansion valve on its portion situated between the fourth heat exchanger and a junction point of the eighth and ninth conduits. The heat pump system is further provided with tenth, eleventh and twelfth conduits.

1 Claim, 1 Drawing Sheet

HEAT PUMP SYSTEM

BACKGROUND OF THE INVENTION

1. Field of the Invention

The present invention relates, in general, to a heat pump system and, more particularly, to a heat pump system that is capable of performing a heating operation and a cooling operation at the same time or selectively performing a heating or a cooling operation.

2. Description of the Prior Art

As well known to those skilled in the art, a general heat pump system is constructed by sequentially connecting a compressor, a four-way valve, a first heat exchanger (an indoor heat exchanger), two expansion valves, a second heat exchanger (an outdoor heat exchanger) and the four-way valve to each other by a conduit and additionally connecting the four-way valve to the compressor by a suction conduit, thus forming a refrigeration circuit.

In a heating operation, in a state where the four-way valve is manipulated to allow refrigerant to flow toward the first heat exchanger, there is repeated a cycle in which high temperature and high pressure refrigerant compressed in the compressor is condensed in the first heat exchanger and simultaneously radiates condensation heat to generate hot water or heat room air for the heating of a room or drying of articles, the compressed refrigerant liquid is expanded in the expansion valve and evaporated into low temperature and low pressure refrigerant gas by means of the ambient air in the second heat exchanger functioning as an evaporator, and the refrigerant gas is sucked into the compressor.

On the other hand, in a cooling operation, in a state where the four-way valve is manipulated to allow refrigerant to flow toward the second heat exchanger, there is repeated a cycle in which high temperature and high pressure refrigerant compressed in the compressor is condensed in the second heat exchanger functioning as a condenser, the condensed refrigerant liquid is expanded in the expansion valve, the expanded refrigerant is evaporated into low temperature and low pressure refrigerant gas in the first heat exchanger and simultaneously absorbs evaporation heat to generate cold water or cool room air for the cooling of a room or refrigeration of articles, and the evaporated refrigerant is sucked into the compressor.

However, in the conventional heat pump system, since the heating or cooling operation is selectively performed by utilizing the condensation or evaporation heat of the first heat exchanger and discarding the condensation or evaporation heat of the second heat exchanger, the effective utilization of heat is almost impossible. Additionally, when a heating operation and a cooling operation are desired to be performed at the same time, a pair of heat pump systems must be installed, thereby complicating the construction of a facility, occupying a great deal of installation area and increasing facility costs.

SUMMARY OF THE INVENTION

Accordingly, the present invention has been made keeping in mind the above problems occurring in the prior art, and an object of the present invention is to provide a heat pump, which is capable of performing a heating operation and a cooling operation at the same time or selectively, thereby effectively utilizing heat, simplifying the construction of a facility and reducing the installation area of the facility.

In order to accomplish the above object, the present invention provides a heat pump system, comprising: a base heat pump system constructed in such a way that a compressor, a four-way valve, a first heat exchanger, two expansion valves, a second heat exchanger and the four-way valve are sequentially connected to each other by first, second, third, fourth, fifth and sixth conduits, and the four-way valve is additionally connected to the compressor by a suction conduit; a third heat exchanger disposed on an eighth conduit, the eighth conduit connecting a seventh conduit, connected to the fourth conduit at its both ends, to the portion of the fourth conduit situated between two junction points of the fourth and seventh conduits; a fourth heat exchanger disposed on a ninth conduit, the ninth conduit connecting the second conduit to the portion of the eighth conduit situated between the third heat exchanger and a junction point of the fourth and eighth conduits and being provided with an additional expansion valve on its portion situated between the fourth heat exchanger and a junction point of the eighth and ninth conduits; a tenth conduit connecting the sixth conduit to the portion of the ninth conduit situated between the additional expansion valve and the junction point of the eighth and ninth conduits; an eleventh conduit connecting the portion of the eighth conduit situated between the junction point of the eighth and ninth conduits and the junction point of the fourth and eighth conduits to the tenth conduit; and a twelfth conduit connecting the portion of the ninth conduit situated between the fourth heat exchanger and a junction point of the second and ninth conduits to the portion of the tenth conduit situated between a junction point of the tenth and eleventh conduits and a junction point of the sixth and tenth conduits.

BRIEF DESCRIPTION OF THE DRAWING

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
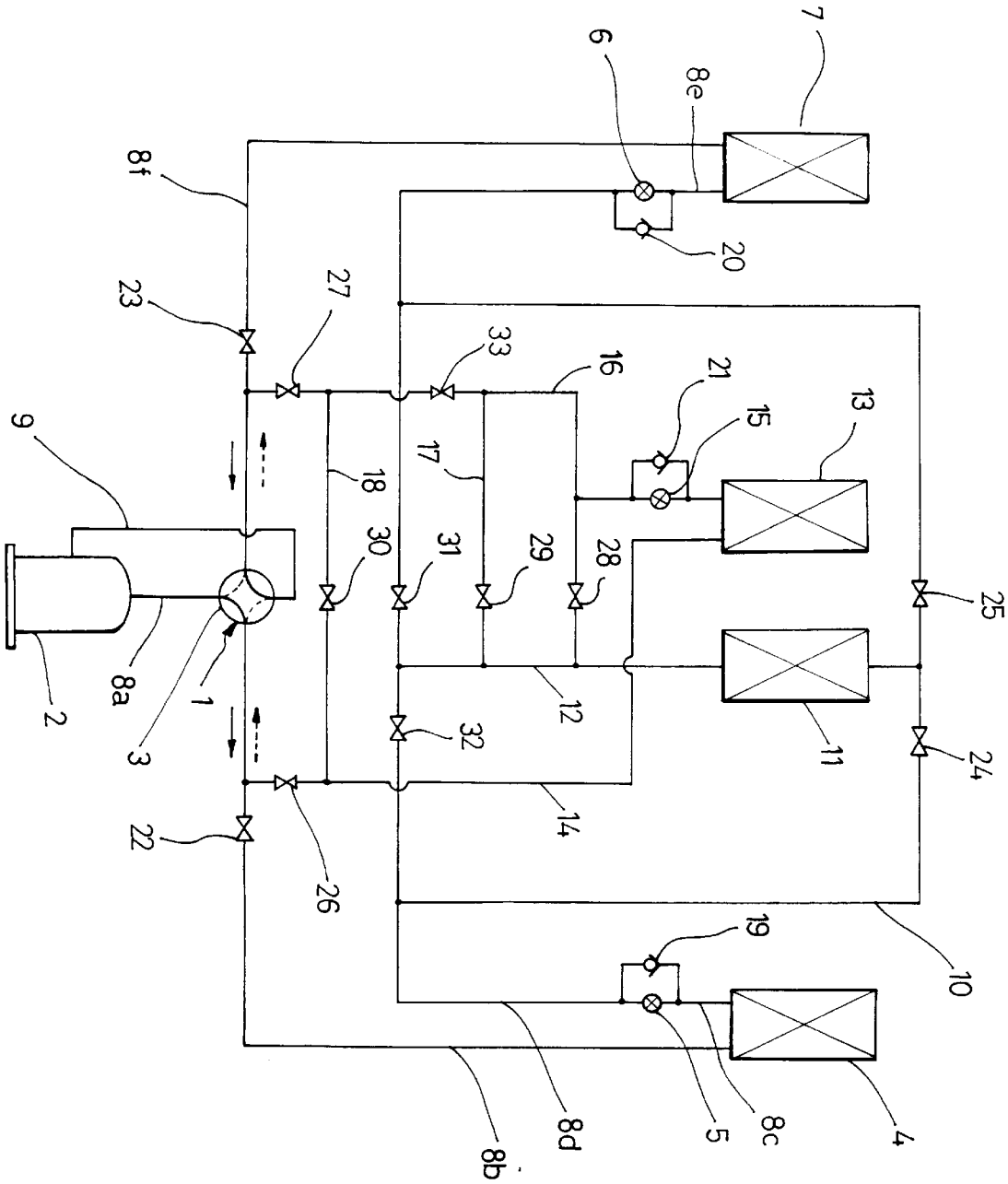
FIG. 1 is a refrigeration circuit diagram of a heat pump system in accordance with a preferred embodiment of the present invention.

FIG. 1 is a refrigeration circuit diagram of a heat pump system in accordance with a preferred embodiment of the present invention.

The heat pump system 1 includes a base heat pump system. The base heat pump system is constructed by sequentially connecting a compressor 2, a four-way valve 3, a first heat exchanger 4, two expansion valves 5 and 6, a second heat exchanger 7 and the four-way valve 3 to each other by first, second, third, fourth, fifth and sixth conduits 8*a*, 8*b*, 8*c*, 8*d*, 8*e* and 8*f*, and additionally connecting the four-way valve 3 to the compressor 2 by a suction conduit 9. The first heat exchanger 4 or the second heat exchanger 7 is disposed in a cold or hot water generating tub, a room desired to be cooled or heated, or a storehouse for drying or refrigerating articles. The first heat exchanger 4 and the second heat exchanger 7 perform a heating operation and a cooling operation at the same time, or selectively perform a heating operation or a cooling operation.

A seventh conduit 10 is formed to be connected to the fourth conduit 8*d* at its both ends, and an eighth conduit 12 is formed to connect the seventh conduit 10 to the portion of the fourth conduit 8*d* situated between two junction points of the fourth and seventh conduits 8*d* and 10. A third heat exchanger 11 is disposed on the eighth conduit 12 to be exposed to the atmosphere, and functions as a second condenser or not.

A ninth conduit 14 is formed to connect the second conduit 8*b* to the portion of the eighth conduit 12 situated between the third heat exchanger 11 and the junction point of the fourth and eighth conduits 8*d* and 12. The ninth conduit 14 is provided with an additional expansion valve 15 on its portion situated between the fourth heat exchanger 13 and the junction point of the eighth and ninth conduits 12 and 14. The fourth exchanger 13 functions as a condenser or evaporator, or not.

A tenth conduit 16 is formed to connect the sixth conduit 8*f* to the portion of the ninth conduit 14 situated between the additional expansion valve 15 and the junction point of the eighth and ninth conduits 12 and 14.

An eleventh conduit 17 is formed to connect the portion of the eighth conduit 12 situated between the junction point of the eighth and ninth conduits 12 and 14 and the junction point of the fourth and eighth conduits 8*d* and 12 to the tenth conduit 16.

A twelfth conduit 18 is formed to connect the portion of the ninth conduit 14 situated between the fourth heat exchanger 13 and the junction point of the second and ninth conduits 8*b* and 14 to the portion of the tenth conduit 16 situated between the junction point of the tenth and eleventh conduits 16 and 17 and the junction point of the sixth and tenth conduits 8*f* and 16.

Reference numerals 19, 20 and 21 designate check valves, and reference numerals 22 to 33 designate valves.

The operations of the heat pump system of the present invention are described, hereinafter.

I. SYNCHRONOUS HEATING AND COOLING OPERATIONS

1. Case where the First and Second Heat Exchangers Perform the Heating and Cooling Operations, Respectively When the compressor 2 is operated after the four-way valve 3 is manipulated to allow refrigerant to flow in a passage designated by the solid arrows of the drawing, the valves 22, 23, 24 and 31 are opened and the other valves are closed, there is repeated a cycle in which refrigerant is compressed into high temperature and high pressure refrigerant gas in the compressor 2, the compressed refrigerant gas flows to the first heat exchanger 4 through the four-way valve 3 and the second conduit 8*b*, the compressed refrigerant gas is condensed into refrigerant liquid in the first heat exchanger 4 functioning as a condenser and simultaneously radiates condensation heat to fluid such as water and air to heat water for the generation of hot water or heat room air for the heating of a room or the drying of articles, the condensed low temperature refrigerant liquid passes through the check valve 19 and the seventh conduit 10, is completely condensed in the third heat exchanger 11, passes through the eighth and fourth conduits 12 and 8*d* and is expanded in the expansion valve 6, the expanded refrigerant liquid is evaporated into low temperature and low pressure refrigerant gas in the second heat exchanger 7 functioning as an evaporator and simultaneously absorbs evaporation heat from fluid to cool water for the generation of cold water or cool room air for the cooling of a room or the refrigeration of articles, the evaporated low temperature and low pressure refrigerant gas is sucked into the compressor 2 through the sixth conduit 8*f*, the four-way valve 3 and the suction conduit 9. In this case, the fourth heat exchanger 13 stops.

2. Case where the First and Second Heat Exchangers Perform the Cooling and Heating Operations, Respectively When the compressor 2 is operated after the four-way valve 3 is manipulated to allow refrigerant to flow in a passage designated by the phantom arrows of the drawing, the valves 22, 23, 25 and 32 are opened and the other valves are closed, there is repeated a cycle in which refrigerant is compressed into high temperature and high pressure refrigerant gas in the compressor 2, the compressed refrigerant gas flows to the second heat exchanger 7 through the four-way valve 3 and the sixth conduit 8*f*, the compressed refrigerant gas is condensed into refrigerant liquid in the second heat exchanger 7 functioning as a condenser and simultaneously performs its heating function, the condensed low temperature refrigerant liquid passes through the check valve 20 and the seventh conduit 10, is completely condensed in the third heat exchanger 11 by means of the atmospheric air, passes through the eighth and fourth conduits 12 and 8*d* and is expanded in the expansion valve 5, the expanded refrigerant liquid is evaporated into low temperature and low pressure refrigerant gas in the first heat exchanger 4 functioning as an evaporator and simultaneously absorbs evaporation heat from fluid to perform its cooling function, and the evaporated low temperature and low pressure refrigerant gas is sucked into the compressor 2 through the second conduit 8*b*, the four-way valve 3 and the suction conduit 9. In this case, the fourth heat exchanger 13 stops.

II. HEATING OR COOLING OPERATION PERFORMED BY ONLY THE FIRST HEAT EXCHANGER

1. Heating Operation of the First Heat Exchanger

When the compressor 2 is operated after the four-way valve 3 is manipulated to allow refrigerant to flow in a passage designated by the solid arrows of the drawing, the valves 22, 24, 27, 29 and 30 are opened and the other valves are closed, there is repeated a cycle in which refrigerant is compressed into high temperature and high pressure refrigerant gas in the compressor 2, the compressed refrigerant gas flows to the first heat exchanger 4 through the four-way valve 3 and second conduit 8*b*, the compressed refrigerant gas is condensed into refrigerant liquid in the first heat exchanger 4 functioning as a condenser and simultaneously radiates condensation heat to perform its heating function, the condensed low temperature refrigerant liquid passes through the check valve 19, the fourth conduit 8*d* and the seventh conduit 10, is completely condensed in the third heat exchanger 11 functioning as a second condenser by means of the atmospheric air, passes through the eighth conduit 12, the eleventh conduit 17 and the tenth conduit 16 and is expanded in the expansion valve 15, the expanded refrigerant liquid is evaporated into low temperature and low pressure refrigerant gas in the fourth heat exchanger 13 by means of the atmospheric air, and the evaporated low temperature and low pressure refrigerant gas is sucked into the compressor 2 through the ninth conduit 14, the twelfth conduit 18 and the sixth conduit 8*f*. In this case, the second heat exchanger 7 stops.

When the refrigerant liquid is evaporated in the fourth heat exchanger 13 by means of the atmospheric air, the condensation heat radiated from the third heat exchanger 11 is supplied to the fourth heat exchanger 13, which prevents frost from being deposited on the fourth heat exchanger 13 in the winter season. Accordingly, the refrigerant liquid is evaporated effectively in the winter season and the heating capacity is not reduced in the winter season.

2. Cooling Operation of the First Heat Exchanger

When the compressor 2 is operated after the four-way valve 3 is manipulated to allow refrigerant to flow in a passage designated by the phantom arrows of the drawing, the valves 22, 27, 28, 30 and 32 are opened and the other valves are closed, there is repeated a cycle in which refrigerant is compressed into high temperature and high pressure refrigerant gas in the compressor 2, the compressed refrigerant gas flows to the fourth heat exchanger 13 through the four-way valve 3, the twelfth conduit 18 and the ninth conduit 14, the compressed refrigerant gas is condensed into refrigerant liquid in the fourth heat exchanger 13 functioning as a condenser, the condensed low temperature refrigerant liquid passes through the check valve 21, the eighth conduit 12 and the fourth conduit 8*d* and is expanded in the expansion valve 5, the expanded refrigerant liquid is evaporated into low temperature and low pressure refrigerant gas in the first heat exchanger 4 functioning as a condenser and simultaneously absorbs evaporation heat to perform its cooling function and the evaporated low temperature and low pressure refrigerant gas is sucked into the compressor 2. In this case, the second heat exchanger 7 and the third heat exchanger 11 stop.

III. HEATING OR COOLING OPERATION PERFORMED BY ONLY THE SECOND HEAT EXCHANGER

1. Heating Operation of the Second Heat Exchanger

When the compressor 2 is operated after the four-way valve 3 is manipulated to allow refrigerant to flow in a passage designated by the phantom arrows of the drawing, the valves 23, 25, 26, and 29 are opened and the other valves are closed, there is repeated a cycle in which refrigerant is compressed into high temperature and high pressure refrigerant gas in the compressor 2, the compressed refrigerant gas flows to the second heat exchanger 7 through the four-way valve 3 and sixth conduit 8*f*, the compressed refrigerant gas is condensed into refrigerant liquid in the second heat exchanger 7 functioning as a condenser and simultaneously radiates condensation heat to fluid to perform its heating function, the condensed low temperature refrigerant liquid passes through the check valve 20 and the seventh conduit 10, is completely condensed in the third heat exchanger 11 functioning as a second condenser by means of the atmospheric air, passes through the eighth conduit 12, the eleventh conduit 17 and the tenth conduit 16 and is expanded in the expansion valve 15, the expanded refrigerant liquid is evaporated into low temperature and low pressure refrigerant gas in the fourth heat exchanger 13 by means of the atmospheric air, and the evaporated low temperature and low pressure refrigerant gas is sucked into the compressor 2 through the ninth conduit 14 and the second conduit 8*b*. In this case, the first heat exchanger 7 stops.

When the refrigerant liquid is evaporated in the fourth heat exchanger 13 by means of the atmospheric air, the condensation heat radiated from the third heat exchanger 11 is supplied to the fourth heat exchanger 13, which prevents frost from being deposited on the fourth heat exchanger 13 in the winter season. Accordingly, the refrigerant liquid is evaporated effectively in the winter season, and the heating capacity is not reduced in the winter season.

2. Cooling Operation of the Second Heat Exchanger

When the compressor 2 is operated after the four-way valve 3 is manipulated to allow refrigerant to flow in a passage designated by the solid arrows of the drawing, the valves 23, 26, 28 and 31 are opened and the other valves are closed, there is repeated a cycle in which refrigerant is compressed into high temperature and high pressure refrigerant gas in the compressor 2, the compressed refrigerant gas flows to the fourth heat exchanger 13 through the four-way valve 3, the second conduit 8*b* and the ninth conduit 14, the compressed refrigerant gas is condensed into refrigerant liquid in the fourth heat exchanger 13 functioning as a condenser by means of the atmospheric air, the condensed refrigerant liquid passes through the check valve 21, the eighth conduit 12 and the fourth conduit 8*d* and is expanded in the expansion valve 5, the expanded refrigerant liquid is evaporated into low temperature and low pressure refrigerant gas in the second heat exchanger 7 functioning as a condenser and simultaneously absorbs evaporation heat to perform its cooling function and the evaporated low temperature and low pressure refrigerant gas is sucked into the compressor 2 through the sixth conduit 8*f*. In this case, the first heat exchanger 4 and the third heat exchanger 11 stop.

As described above, the present invention provides the heat pump system, which is capable of performing a heating operation and a cooling operation at the same time or selectively performing a heating operation or a cooling operation by disposing the third and fourth heat exchangers on a base heat pump system, thereby conserving energy by utilizing the first and second heat exchangers, and reducing manufacturing and installing costs owing to the simplification of the construction of a facility and reduction of the installation area of the facility.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump system, comprising a base heat pump system comprised of a compressor, a four-way valve disposed on a first conduit connected to an exit of said compressor, a first heat exchanger disposed on a second conduit connected to said four-way valve, a cooling expansion valve disposed on a third conduit connected to said first heat exchanger, a heating expansion valve disposed on a fourth conduit connected to said cooling expansion valve, a second heat exchanger disposed on a fifth conduit connected to the heating expansion valve, a sixth conduit connecting the second heat exchanger to said four-way valve, and a suction conduit connecting the four-way valve to an inlet of said compressor;

a third heat exchanger located on an eighth conduit, said eighth conduit connecting a seventh conduit, which is connected to said fourth conduit at both its ends, to a portion of said fourth conduit situated between two junction points of said fourth and seventh conduits;

a fourth heat exchanger disposed on a ninth conduit, said ninth conduit connecting said second conduit to a portion of said eighth conduit situated between said third heat exchanger and a junction point of said fourth and eighth conduits and being provided with an additional expansion valve on its portion situated between said fourth heat exchanger and a junction point of said eighth and ninth conduits;

a tenth conduit connecting said sixth conduit to a portion of said ninth conduit situated between said additional expansion valve and the junction point of said eighth and ninth conduits;

an eleventh conduit connecting a portion of said eighth conduit situated between the junction point of said eighth and ninth conduits and the junction point of said fourth and eighth conduits to said tenth conduit; and a twelfth conduit connecting a portion of said ninth conduit situated between said fourth heat exchanger and a junction point of said second and ninth conduits to a portion of said tenth conduit located between a junction point of said tenth and eleventh conduits and a junction point of said sixth and tenth conduits.

* * * * *